US007210956B2

(12) United States Patent
White

(10) Patent No.: US 7,210,956 B2
(45) Date of Patent: May 1, 2007

(54) CONTACT

(75) Inventor: Rowland White, Blandford Forum (GB)

(73) Assignee: Wheeler & Clinch Limited, London (GB)

( * ) Notice: Subject to any disclaimer, the term of this patent is extended or adjusted under 35 U.S.C. 154(b) by 0 days.

(21) Appl. No.: 10/501,235

(22) PCT Filed: Mar. 7, 2003

(86) PCT No.: PCT/GB03/00960

§ 371 (c)(1),
(2), (4) Date: Jul. 12, 2004

(87) PCT Pub. No.: WO03/083996

PCT Pub. Date: Oct. 9, 2003

(65) Prior Publication Data

US 2005/0090139 A1 Apr. 28, 2005

(30) Foreign Application Priority Data

Mar. 28, 2002 (GB) ..... 0207482.1

(51) Int. Cl.
*H01R 11/20* (2006.01)

(52) U.S. Cl. ..... 439/395

(58) Field of Classification Search ..... 439/395–417
See application file for complete search history.

(56) References Cited

U.S. PATENT DOCUMENTS

| | | | | |
|---|---|---|---|---|
| 3,798,587 | A | 3/1974 | Ellis, Jr. et al. | |
| 4,171,857 | A | 10/1979 | Forberg et al. | |
| 4,591,223 | A | 5/1986 | Vachhani | |
| 4,611,874 | A * | 9/1986 | Gerke et al. | 439/404 |
| 5,522,733 | A | 6/1996 | White et al. | |
| 5,759,061 | A * | 6/1998 | Jensen et al. | 439/402 |
| 5,836,782 | A * | 11/1998 | Odley et al. | 439/397 |
| 5,848,911 | A * | 12/1998 | Garcin | 439/395 |
| 5,911,593 | A * | 6/1999 | Glaser et al. | 439/395 |
| 6,027,361 | A | 2/2000 | Burmeister et al. | |

* cited by examiner

*Primary Examiner*—Briggitte R. Hammond
(74) *Attorney, Agent, or Firm*—Lowe Hauptman & Berner, LLP

(57) ABSTRACT

A contact for establishing electrical connection with an electrically conductive wire, the contact being manufactured from a planar material and having a base and a pair of elongate blades extending from the base and defining there between a channel within which a wire is to be received, a flat contact surface of one blade and a cutting edge of the other blade lying on opposite sides of the channel, the flat contact surface maintaining the wire substantially parallel to the flat contact surface through the channel.

12 Claims, 3 Drawing Sheets

CONTACT

CROSS-REFERENCES TO RELATED APPLICATIONS

The present Application is based on International Application No. PCT/GB03/00960, filed on Mar. 7, 2003, entitled "A CONTACT", which in turn corresponds to GB 0207482.1 filed on Mar. 28, 2002, and priority is hereby claimed under 35 USC §119 and 35 USC §120 based on these applications. Each of these applications are hereby incorporated by reference in their entirety into this application.

FIELD OF THE INVENTION

THE PRESENT INVENTION relates to a contact, and in particular to a contact of an insulation displacement connector.

A contact of an insulation displacement connector removes or pierces an insulating covering of an insulated wire during connection of the wire to the connector and makes electrical contact with the electrical conductor within the insulating covering. Such contacts and connectors are well known in the telecommunications industry. Insulation displacement connectors allow the swift connection of a wire to a device, without the need for preparation of the wire by removal of the insulating covering prior to insertion in the connector.

SUMMARY OF THE INVENTION

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

Conventionally, the contacts of an insulation displacement connector comprise a pair of cutting members or tines having opposed cutting edges. A wire to be connected to the contact is pushed between the cutting edges. The distance between the cutting edges is calibrated to be approximately equal to or slightly less than the diameter of the conductive core of the wire, so that the action of pushing the wire between the cutting edges causes the cutting edges to slice through the insulating covering of the wire, removing the insulating covering and contacting the cutting edges with the conductive core thereby establishing electrical connection. Usually a plurality of such cutting members (the same number as wires to be connected) are held in a housing block of the insulation displacement connector.

Most current insulation displacement connectors are designed for use with standard telephone cable. However, relatively recent developments in technology have rendered standard telephone cable increasingly obsolete, and higher speed transmission cables are becoming increasingly common. One of the most significant changes to have occurred in cable design relates to the characteristics of the material used to form the insulating covering of individual wires. Whereas standard telephone cable employs an insulating covering comprising a relatively soft PVC material, many different materials are used to insulate modern cables to enhance the performance thereof, and many of the different materials are significantly more difficult to penetrate and cut than the conventional soft PVC material.

Hence, many conventional insulation displacement connectors are inadequate for use with modern cables, and may require excessive force to insert a cable, or may often fail to make successful connections with cables.

Typically, as illustrated in FIG. 1 of the accompanying drawings, an insulation displacement connector includes a contact comprising a sheet of material from which a slot has been cut out. As described above, the width of the slot is calibrated to be approximately equal to or slightly less than the diameter of the core of an insulated wire with which the contact is to be used. To establish an electrical connection, the wire is forced through the slot, so that the inner edges thereof cut through the insulating covering of the wire leaving the conductive core thereof exposed and in contact with the inner edges.

One method of improving the cutting properties of a contact of this type is to rotate the sheet of material from which the contact is formed through around 45° with respect to the longitudinal axis of a wire (the wire-axis) to be inserted therein.

Further, it is generally accepted that arranging a planar contact at approximately 45 degrees to the wire axis gives more reliable two-wire connection than where the contact blades are at right angles to the wire axis. This is principally because, when the contact is at about a 45 degree angle, the displacement of the contact blades is torsional, and thus there is always a residual spring force in the wire contact area, this force being capable of contacting a second wire introduced into the same slot. In the case of planar blades at right angles to the wire, the blade displacement is by a shearing force, which is less likely to result in residual spring force at the contact area, and hence contact for a second wire is seriously compromised.

Unfortunately, contacts which operate at about 45 degrees to the wire axis exert a residual torsional force on the wire, tending to turn the wire towards 90 degrees with the contact blades. This is corrected by the use of "clamping elements" as disclosed in U.S. Pat. No. 4,171,857 in the connector body, see FIG. 1 of the accompanying drawings, which are intended to maintain the wire securely in the correct axis. Of course, these always rely on the ability of one type of plastics material to firmly retain a grip on a second type of plastics material, which may not always be reliable.

The only way to overcome this residual force with a planar contact has been to arrange the contact at 90 degrees to the wire axis, and in this situation, as mentioned above, the contact is unreliable with two wires connected, as the shearing force displacement of the blades leaves no residual force available to contact the second wire in the same slot. This can be overcome by the introduction of a second slot—one slot for each wire—but the resulting contact is much wider, and hence connection density is around 30% to 50% less than with angled contacts.

There also exists in the prior art two contact designs in which the cutting blade displacement is torsional, but where no residual force is present at the contacts. These are the slotted tubular contact disclosed in U.S. Pat. No. 4,591,223 (Vachhani) and the "V" contact disclosed in U.S. Pat. No. 5,522,733 (White). In both of these contacts the blade displacement is torsional, but they retain the wire in the correct position without the need for the clamping elements disclosed in U.S. Pat. No. 4,171,857.

However, these two contacts also have drawbacks: firstly they use more material than a planar contact, and they are more complex in manufacture, requiring part-stamping, folding or rolling operations, which are secondary stations in the manufacturing tooling. Furthermore, and by the nature of their designs, they create notches on diametrically opposing sides of the wire conductor, which can lead to premature mechanical failure at this point. This is a known weakness of these concepts.

Therefore, it is an object of the new design to provide an essentially planar contact, which may be mounted at an angle to the conductor, which does not apply residual torsional force to the wire, and which does not create notches at points which are diametrically opposite one another across the conductor.

Accordingly, one aspect of the present invention provides a contact for establishing electrical connection with an electrically conductive wire, the contact being manufactured from a planar material and having a base and a pair of elongate blades extending from the base and defining therebetween a channel within which a wire is to be received, a first blade of the pair being flat and a second blade of the pair being shaped, a flat contact surface of one blade being opposite a cutting edge of the other blade and lying on opposite sides of the channel, the flat contact surface maintaining the wire substantially parallel to the flat contact surface through the channel and the cutting edge of the other blade pointing towards the flat contact surface.

Preferably, the second blade is shaped so as to present the flat contact surface to the cutting edge of the other blade.

Conveniently, the shaped blade prescribes an arc about an axis parallel to the longitudinal axis of the shaped blade.

Advantageously, the blades each have two major surfaces and two minor surfaces and the flat contact surface comprises a minor surface of one blade proximate the other blade.

Preferably, the blades each have two major surfaces and two minor surfaces and the flat contact surface comprises a portion of a major surface of one blade proximate the other blade.

Conveniently, the blades each have two major surfaces and two minor surfaces and the cutting edge comprises a corner of a major surface with a minor surface of the other blade proximate the one blade.

Advantageously, the flat contact surface lies in a first plane and the planes of the two surfaces defining the cutting edge lie in a second and a third plane respectively, the second and third planes being respectively between 30° and 60° to the first plane.

Preferably, the second and third planes are in the region of 45° to the first plane.

Another aspect of the present invention provides a contact for establishing electrical connection with an electrically conductive wire, the contact being manufactured from a planar material and having a base and a pair of elongate blades extending from the base and defining therebetween a channel within which a wire is to be received, a first blade of the pair being flat and a second blade of the pair being shaped, a flat contact surface of one blade and a cutting edge of the other blade lying on opposite sides of the channel, wherein a line drawn parallel to the flat contact surface and passing through the point defined by the end of the cutting edge is not parallel to either of the surfaces defining the cutting edge.

Preferably, an insulation displacement connector includes one or more contacts embodying the present invention.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

Figure 1:
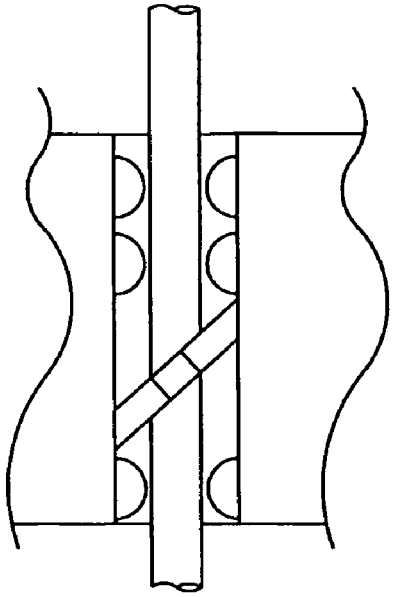
FIG 1 (PRIOR ART)
FIG. 1 is a plan view of a conventional insulation displacement connector incorporating clamping elements.
Figure 2:
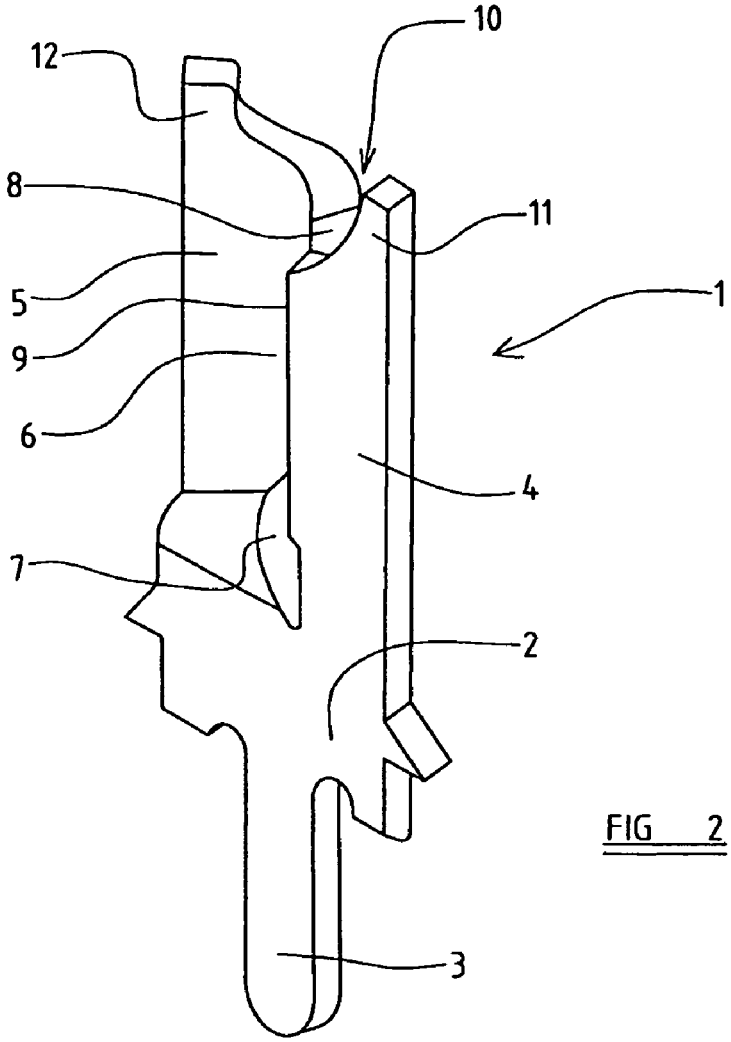
FIG. 2 is a perspective view of a contact embodying the present invention.

Turning firstly to FIG. 2, a contact 1 embodying the present invention is manufactured from a planar material and comprises a planar base 2 having an integrally formed terminal 3 depending therefrom. The base 2 and the terminal 3 are coplanar.

At the opposite end of the base 2 from the terminal 3, a first and a second elongate blade 4,5 are provided. The blades 4,5 extend away from the base 2 in the opposite direction to the terminal 3. The base 2, terminal 3 and blades 4,5 are formed from a single sheet of material, which is preferably brass or any other material having suitable properties.

Figure 3:
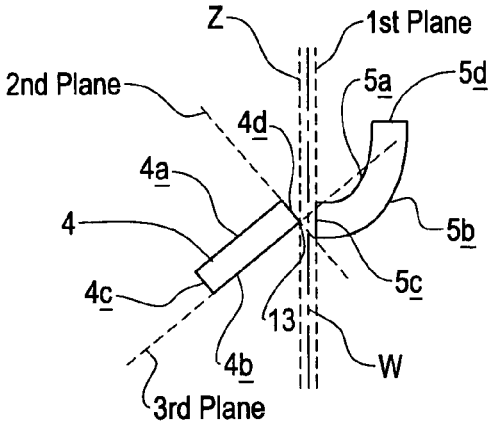
FIG. 3 is a schematic plan view of the blades only of the contact of FIG. 2.
Figure 4:
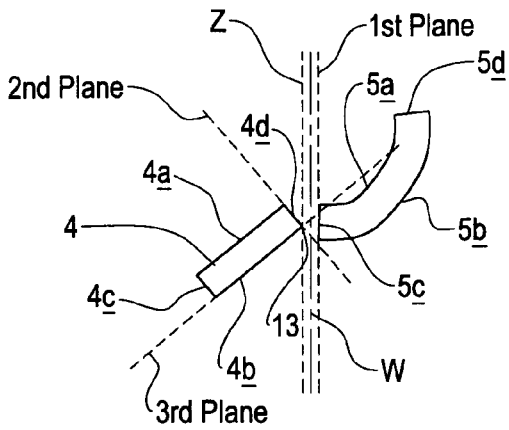
FIGS. 4 to 7 are schematic plan views of the blades only of further contact embodying the present invention.
Figure 5:
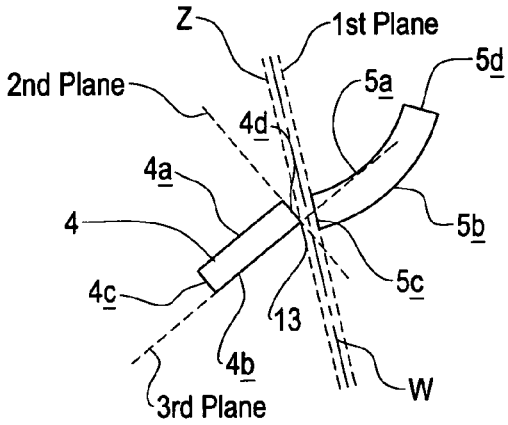
Figure 6:
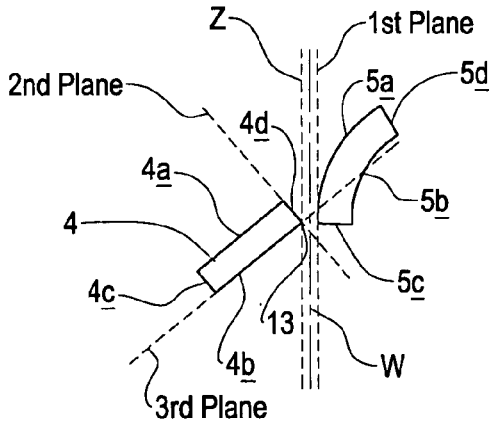
Figure 7:
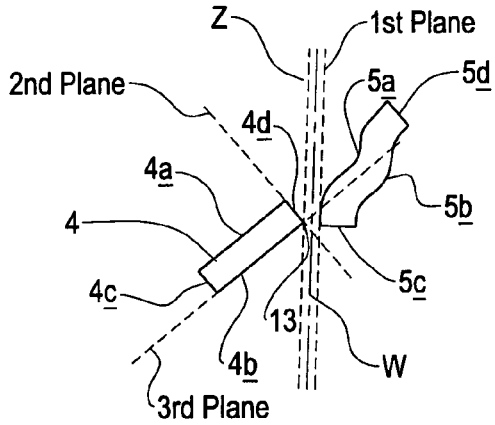

As shown in FIGS. 2 and 3, the first blade 4 is coplanar with the base 2 and the terminal 3, but the second blade 5 is shaped with respect to the base 2 such that it prescribes an arc radiussed about an axis substantially parallel to the longitudinal axes of the blades 4,5. The type, location and extent of the radius can be varied as shown by the different arcs used in FIGS. 3 to 7.

A narrow channel 6 is formed between the blades 4,5. Where the channel 6 meets the base 2, the channel 6 widens out into a cut-out portion 7. Over the length of the channel 6, the blade edges 8,9 which define the channel 6 are parallel to one another. The mouth 10 to the channel 6 defined by the free ends 11,12 of the blades 4,5 provides a narrowing entrance between the blades 4,5 to guide a wire to be inserted between the blades 4,5 into the channel 6.

Turning to FIGS. 3 to 7, these figures are schematic plan views of the blades 4,5 only of contacts 1 embodying the present invention from which the relative orientations of the two blades 4,5 can be clearly seen.

The relative orientation between the blades 4,5 is now described in further detail. Referring to FIG. 3, each blade 4,5 has two main surfaces 4A, 4B; 5A,5B and two minor surfaces 4C, 4D; 5C, 5D, the minor surfaces 4D, 5C being proximate one another. The channel 6 for receiving the or each wire is specifically defined by the gap between the minor surface 5C and a corner 13 of the proximate minor surface 4D with the major surface 4B. The corner 13 is opposite and "pointing" towards the flat minor surface 5C. In this manner, the two blades 4,5 of the contact 1 are arranged such that, at the point of contact with the wire, one blade 4 is substantially at 45 degrees to the wire axis W and the other blade S is substantially perpendicular to the wire axis W. This is very different to the cutting action of prior blade designs. This design uses one relatively sharp cutting edge, the corner 13, in conjunction with one relatively flat and wide contact face (the minor surface 5C in the examples of FIGS. 3 to 5 and a portion of the major surface 5A in the examples of FIGS. 6 and 7).

FIGS. 3 to 7 include an axis Z depicting a line drawn parallel to the flat contact surface and passing through a point defined by the end of the cutting edge which is not parallel to either of the surfaces defining the cutting edge. The axis Z may be viewed as a cross-section of a plane extending along the longitudinal axis of the contact.

The cutting corner 13 of contacts 1 embodying the present invention easily cuts insulation around a conductor allowing the insulation to be readily stretched and pushed aside to allow contact between the stripped conductor and the flat wide contact face 5C,5A. This provides a larger contact area between the conductor and the contact than has previously been possible with conventional contacts which sandwich the conductor between two cutting corners. The larger contact area is extremely advantageous as it lowers the contact impedance. For high speed data circuits, low contact impedance is a critical design factor in datacomms connector technology.

Another important advantage of contacts 1 embodying the present invention is that, since the sharp cutting corner 13 aligns with substantially the centre of the flat contact face 5C, 5A, these being at an angle in the region of 135 degrees to one another, although the force on the blades 4, 5 themselves is torsional, there is no residual twisting force on the wire inserted therebetween which means that the wire is stable at 45 degrees to the contact 1 and the connector body does not need to grip the wire so firmly. The major user advantages derived from this is that the wire orientation is stabilized without the need for clamping elements and a much wide range of insulation diameters can be accommodated in the contact without distorting or otherwise damaging the connector body. In the illustrated examples, the flat face 5C lies in a first plane and the planes of the two surfaces 4D, 4B defining the cutting corner 13 lie in a second and a third plane respectively, the second and third planes being respectively between 30° and 60° to the first plane. More preferably and as shown in FIG. 3, the second and third planes are in the region of 45° to the first plane.

Figure 8:
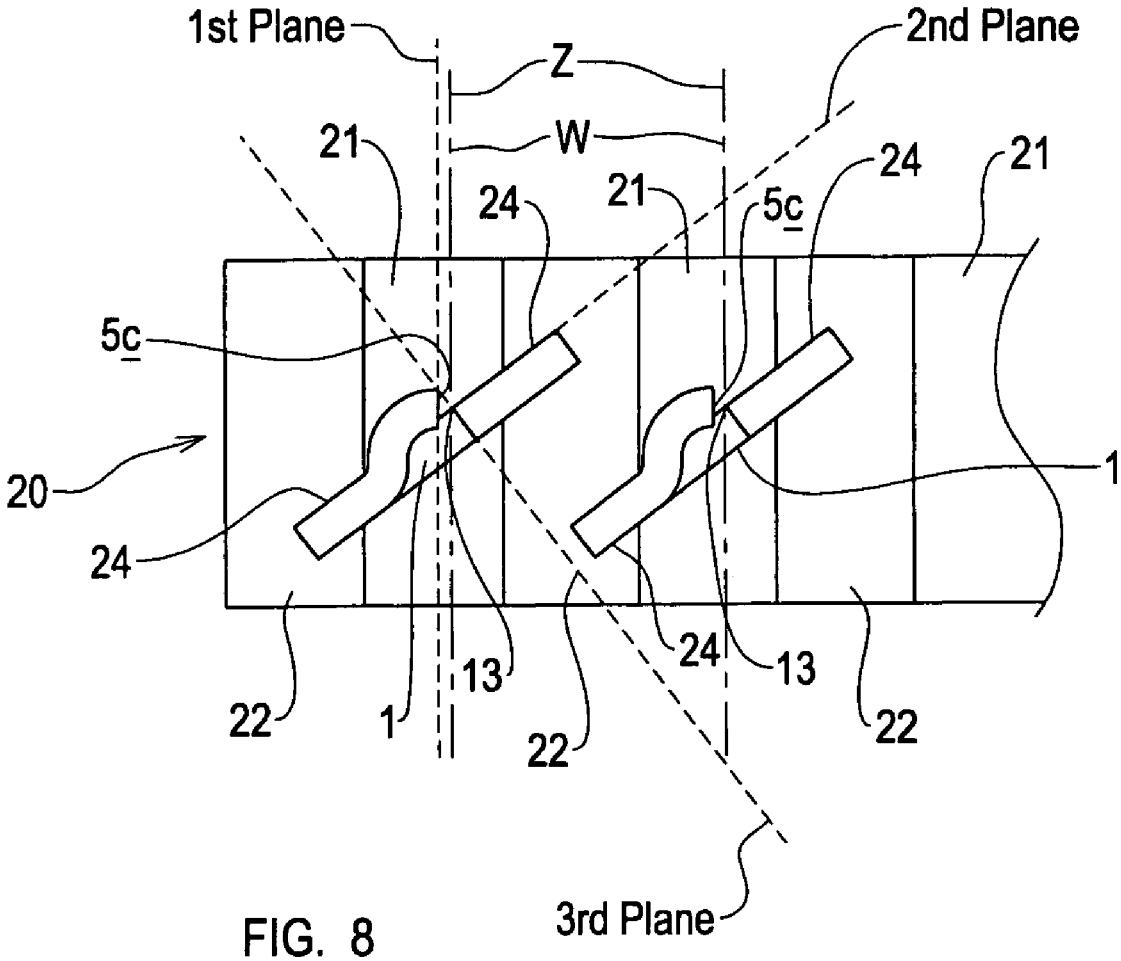
FIG. 8 is a schematic plan view of one end of an insulation displacement connector fitted with contacts embodying the present invention.

Referring now to FIG. 8, one end of an insulation displacement connector 20 is shown housing two contacts 1 embodying the present invention. The connector 20 has equally spaced troughs 21 separated by walls 22. The troughs 21 are intended to receive insulated wires along their length, see wire axes W, and the walls 22 have cut-outs 24 at approximately 45 degrees to the troughs 21 and the wire axes W into which are housed the contacts 1. Thus, the contacts 1 are at approximately 45 degrees to the wire axes W. In this arrangement, the flat contact face 5C,5A of the blade 5 is substantially parallel to the wire axis W and the other blade 4 is at substantially 45 degrees to the wire axis W, thereby cutting the wire insulation with the cutting corner 13.

FIGS. 4 to 7 show other radiuses that can be applied to the blade 5 so that the channel 6 between the blades 4,5 is defined between a flat wide contact face 5C,5A and a cutting corner 13 of the respective blades 5,4. The important design feature in all of these examples is that the channel 6 in which a wire sits is bordered on one side by a flat surface 5C,5A of one blade 5 which maintains the wire in a desired orientation with respect to the contact 1 and on the other side by a cutting corner 13 of the other blade 4.

DESCRIPTION OF THE PREFERRED EMBODIMENT

In use of the contact 1, the plane of the base 2 is positioned at an angle of around 45° to the longitudinal axis W of a wire which is to be connected to the connector housing the contact 1. The wire is positioned in the mouth 10 of the channel 6 and inserted in this orientation into the channel 10 between the blades 4,5. The contact 1 is manufactured so that the distance between the cutting corner 13 and the flat contact surface 5C,5A, i.e. the effective width of the channel 6, is less than the diameter of the conductive core of the wire.

Another way of describing the orientation of the blades 4,5 with respect to one another is to consider a first plane passing through the centre of the blade 4 parallel to its major surfaces 4A,4B and a second plane normal to the centre of the flat contact face 5C,5B—both planes being parallel to the longitudinal axes of the blades 4,5. The first and second planes are preferably at an angle to one another of between 30° and 60°, but most preferably, 45°.

The contact 1 is simple to manufacture, requiring a single stamping step to cut the contact outline, the blades 4,5 apart and to radius the blade 5 into the desired shape. Since the contact 1 is manufactured from a single sheet of material, there is no need to cut a slot of predetermined width from the sheet of material, rather, all that is required to form the two blades 4,5 and the channel 6 therebetween is to shear a portion of the sheet of material in the stamping step into the two blades so that one blade 5 is radiused. In fact, the channel 6 in designs embodying the present invention is in fact displaced from the contact centre line, i.e. the plane of the base 2 and terminal 3, the shaped blade being about 25% wider than the flat blade.

It will be understood that the present invention provides a contact 1 that is effective in operation, and is also cheap and simple to produce.

In present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A contact for establishing electrical connection with an electrically conductive wire, comprising:

a base and two elongate blades extending from the base and defining therebetween a channel within which a wire is to be received, a first blade of the two elongate blades being flat and a second blade of the two elongate blades being shaped and having a longitudinal axis, a flat contact surface of one blade being opposite a cutting edge, defined by two surfaces having respective planes, of the other blade and lying on opposite sides of the channel, the flat contact surface maintaining the wire substantially parallel to the flat contact surface through the channel and the cutting edge of the other blade pointing towards the flat contact surface;

wherein the blades each have two major surfaces and two minor surfaces and the flat contact surface comprises a portion of a major surface of one blade proximate the other blade;

wherein the flat contact surface lies in a first plane and the planes of the two surfaces defining the cutting edge lie in a second and a third plane respectively, the second and third planes being respectively between 30° and 60° to the first plane; and wherein the shaped blade prescribes an arc about an axis parallel to the longitudinal axis of the shaped blade.

2. The contact according to claim 1, wherein the second blade is shaped so as to present the flat contact surface to the cutting edge of the other blade.

3. The contact according to claim 1, wherein the blades each have two major surfaces and two minor surfaces and the flat contact surface comprises a minor surface of one blade proximate the other blade.

4. The contact according to claim 1, wherein the cutting edge comprises a corner of a major surface with a minor surface of the other blade.

5. The contact according to claim 1, wherein the second and third planes are in the region of 45° to the first plane.

6. The insulation of claim 1, wherein the contact is manufactered from a planar material.

7. A contact for establishing electrical connection with an electrically conductive wire, comprising:

a base and two elongate blades extending from the base and defining therebetween a channel within which a wire is to be received, a first blade of the two elongate blades being flat and a second blade of the two elongate blades being shaped, a flat contact surface of one blade and a cutting edge defined by two surfaces of the other blade lying on opposite sides of the channel, wherein a line drawn parallel to the flat contact surface and passing through a point defined by the cutting edge is not parallel to either of the surfaces defining the cutting edge; and wherein the second blade prescribes an arc about an axis parallel to the longitudinal axis of the second blade.

8. The insulation of claim 7, wherein the contact is manufactered from a planar material.

9. The insulation of claim 7, wherein a plane drawn parallel to the flat contact surface and passing through the point defined by the end of the cutting edge is not parallel to either of the surfaces defining the cutting edge.

10. An insulation displacement connector, comprising:

a contact manufactured from a planar material and having a base and two elongate blades extending from the base and defining therebetween a channel within which a wire is to be received, a first blade of the two elongate blades being flat and a second blade of the two elongate blades being shaped, a flat contact surface of one blade being opposite a cutting edge defined by two surfaces of the other blade and lying on opposite sides of the channel, the flat contact surface maintaining the wire substantially parallel to the flat contact surface through the channel and the cutting edge of the other blade pointing towards the flat contact surface;

wherein the blades each have two major surfaces and two minor surfaces and the flat contact surface comprises a portion of a major surface of one blade proximate the other blade;

wherein the flat contact surface lies in a first plane and the planes of the two surfaces defining the cutting edge lie in a second and a third plane respectively, the second and third planes being respectively between 30° and 60° to the first plane; and wherein the second blade prescribes an arc about an axis parallel to the longitudinal axis of the second blade.

11. An insulation displacement connector, comprising:

a contact manufactured from a planar material and having a base and two elongate blades extending from the base and defining therebetween a channel within which a wire is to be received, a first blade of the two elongate blades being flat and a second blade of the two elongate blades being shaped, a flat contact surface of one blade and a cutting edge defined by two surfaces of the other blade lying on opposite sides of the channel, wherein a line drawn parallel to the flat contact surface and passing through a point defined by the cutting edge is not parallel to either of the surfaces defining the cutting edge; and wherein the second blade prescribes an arc about an axis parallel to the longitudinal axis of the second blade.

12. The insulation of claim 11, wherein a plane drawn parallel to the flat contact surface and passing through the point defined by the end of the cutting edge is not parallel to either of the surfaces defining the cutting edge.

* * * * *